US005241887A

United States Patent [19]

Wolff et al.

[11] Patent Number: 5,241,887

[45] Date of Patent: Sep. 7, 1993

[54] CUTTING DEVICE FOR CUTTING FOOD PRODUCTS, IN PARTICULAR SAUSAGE, HAM, BACON, MEAT, CHEESE AND SUCH

[75] Inventors: Michael Wolff, Heimenkirch; Herbert Adler, Lindenberg, both of Fed. Rep. of Germany

[73] Assignee: Natech, Reich, Summer, GmbH & Co. Kg, Opengach, Fed. Rep. of Germany

[21] Appl. No.: 883,841

[22] Filed: May 15, 1992

[30] Foreign Application Priority Data

May 1, 1992 [DE] Fed. Rep. of Germany ..... 4214264

[51] Int. Cl.[5] ..... B26D 1/16

[52] U.S. Cl. ..... 83/401; 83/248; 83/473; 83/490; 83/564; 83/700

[58] Field of Search ..... 83/564, 42, 486, 248, 83/932, 640, 473, 485, 486.1, 490, 700, 679, 401

[56] References Cited

U.S. PATENT DOCUMENTS

| | | | |
|---|---|---|---|
| 1,841,996 | 1/1932 | Van Berkel | 83/248 X |
| 1,941,519 | 1/1934 | Van Berkel | 83/490 |
| 2,996,088 | 8/1961 | Hensley | 83/490 |
| 3,124,178 | 3/1964 | Packard | 143/36 |
| 3,209,635 | 10/1965 | Auld | 83/451 |
| 3,841,188 | 10/1974 | Wiater | 83/471.3 |
| 4,152,961 | 5/1979 | Batson | 83/471.3 |
| 5,146,827 | 9/1992 | Komatsu et al. | 83/564 X |

FOREIGN PATENT DOCUMENTS

| | | |
|---|---|---|
| 503688 | 7/1930 | Fed. Rep. of Germany . |
| 7812759 | 8/1978 | Fed. Rep. of Germany . |
| 3713536 | 11/1988 | Fed. Rep. of Germany . |
| 3714810 | 11/1988 | Fed. Rep. of Germany . |

*Primary Examiner*—Frank T. Yost
*Assistant Examiner*—Kenneth E. Peterson
*Attorney, Agent, or Firm*—Brown, Martin, Haller & McClain

[57] ABSTRACT

Known are cutting devices for cutting food products with a base plate, an orbital-driven circular knife, a product feed unit and a counterknife. The invention proposes a height- adjustable distance of the circular knife to the counterknife along the cutting plane, and a stationary counterknife.

10 Claims, 2 Drawing Sheets

CUTTING DEVICE FOR CUTTING FOOD PRODUCTS, IN PARTICULAR SAUSAGE, HAM, BACON, MEAT, CHEESE AND SUCH

CROSS REFERENCE TO RELATED APPLICATIONS

This application is related to co-pending application Ser. No. 07/883,560 of the same applicants, filed May 15th 1992.

BACKGROUND OF THE INVENTION

The invention concerns a cutting device for cutting food products, in particular sausage, ham, bacon, meat, cheese and such, with a base plate on which are arranged a cutting head featuring a drive unit with an orbital-driven circular knife run along a cutting plane for executing the separating cuts, a product feed unit which feeds the food product to the cutting plane, and a counterknife which supports the food product with its cutting edge arranged along the cutting plane.

Such a cutting device is described for example with the subject of DE 37 14 810 A 1.

SUMMARY OF THE INVENTION

With such cutting devices there is the desire to adjust the so-called knife passage at the counterknife. This involves the lift with which the circular knife is moved through the product to be cut. Such a lift adjustment is desirable in order to achieve a large cutting width with low cutting height, or a high cutting height with low cutting width.

Until now, in order to adjust the cutting lift of the circular knife the counterknife was moved, which had the disadvantage that together with the counterknife the entire feed unit, the product feed and the product holding devices had to be moved. This involves a significant effort and such an adjustment is very costly.

Task of the present invention is therefore to design a cutting device of the type described previously so that settings and adjustments of the cutting device are significantly more economical and simpler.

In order to solve the task of the invention, the distance between circular knife and counterknife of the cutting device is height-adjustable whereby the fixed counterknife is attached to a stationary base plate. For example, the circular knife pivots in a gear housing and the gear housing moves on stationary parts of the cutting device so that the circular knife can be adjusted in a plane parallel to and along the cutting plane in accordance with the invention.

This measure in accordance with the invention offers the advantage that smaller masses need to be moved for setting purposes so that setting and locking may be more exact and more sensitive.

In contrast with the existing technology, the invention further offers the significant advantage that the counterknife no longer needs to be moved together with the product feed unit, product feed, product holding device and such but that the entire circular knife with its drive unit can be readily moved relative to the stationary counterknife.

In addition, there is the advantage that the settings are carried out directly on the active part, the circular knife of the cutting device, so that adjustment procedures through light manual operation control the path of the circular knife.

In accordance with the invention there are two variants to adjust the height of the circular knife in relation to the stationary counterknife. Both variants have in common that the circular knife can be adjusted in a plane parallel to the cutting plane and along the cutting plane to the stationary counterknife. In accordance with the first and preferred variant, adjustment is through rectilinear moving, and in the second variant through revolving along a pivoting lever arm.

In the preferred first variant of this invention, the gear housing can be moved and secured on stationary housing parts of the cutting device like a longitudinal guide. In a further development of the adjustment drive in accordance with the first variant, a spindle is used which with one part is supported against a stationary plate of the gear housing and which engages a spindle nut connected to the moving part of the gear housing.

In addition to the linear shift of the entire gear housing in the first variant, the second variant of the present invention proposes to pivot the gear housing on a corresponding swivel arm so that also the circular knife can be adjusted in a plane parallel to the cutting plane and related to the height to the counterknife. Pivoting takes place due to the swivel arm on a circular path whereby for example the gear housing is arranged on the front free pivoting part of the lever which pivots with its other end in a stationary pivot.

In a first further development, the axis of the stationary pivot along which is arranged the pivoting lever, can extend parallel to the knife axis of the circular knife. In accordance with a second further development, the axis of the stationary pivot can also be perpendicular to the knife axis. The second variant requires that in addition to the pivoting motion the circular knife executes a tilting motion around the swivel axis. The additional tilting motion ensures that the circular knife remains plane to the cutting plane.

In another development of the invention, devices allow for tilting motions of the circular knife in all variants for adjustment purposes so that the circular knife is aligned plane to the cutting plane. With the tilting device this involves a sufficient number of setscrews arranged in particular around the eccentric axis of the orbital-driven circular knife. The tilt angle of the circular knife in relation to the cutting plane can be changed depending upon the screw-in depth of the screws.

In accordance with another further development, an adjustment device enables the circular knife to be moved by a linear section from the cutting plane, or to be pivoted along a swivel axis. Pivoting or shifting may take place through a lifting mechanism and an operating cylinder. Since the counterknife with its cutting edge is plane to the cutting plane, it is advantageous to move the circular knife away from the counterknife in setting procedures which set the height to the counterknife in accordance with the invention. This offers the advantage that the circular knife is now able to rotate freely in order to execute the setting procedures. Upon completion of the height adjustments of the circular knife in relation to the counterknife as well as to the tilting of the circular knife, the circular knife is returned to the operating position in which it is plane to the cutting plane.

In addition, the lateral move of the circular knife away from the cutting plane is an additional advantage for avoiding the formation of shavings which occurs when product feed is switched off.

Object of the present invention is not only the result of the object of the individual patent claims but also of the combination of individual patent claims. All features and characteristics disclosed in the documentation—including the summary—in particular the arrangement shown in the drawings are claimed as essential to the invention to the extent that jointly or severally they are new in terms of existing technology.

BRIEF DESCRIPTION OF THE DRAWINGS

The following is a more detailed description of the invention through drawings which illustrate one variant. The drawings and their description disclose additional essential characteristics and advantages of the invention.

FIG. 1 shows a circular knife 1 for a cutting device in accordance with the present invention.

DESCRIPTION OF THE PREFERRED EMBODIMENTS

Figure 1:
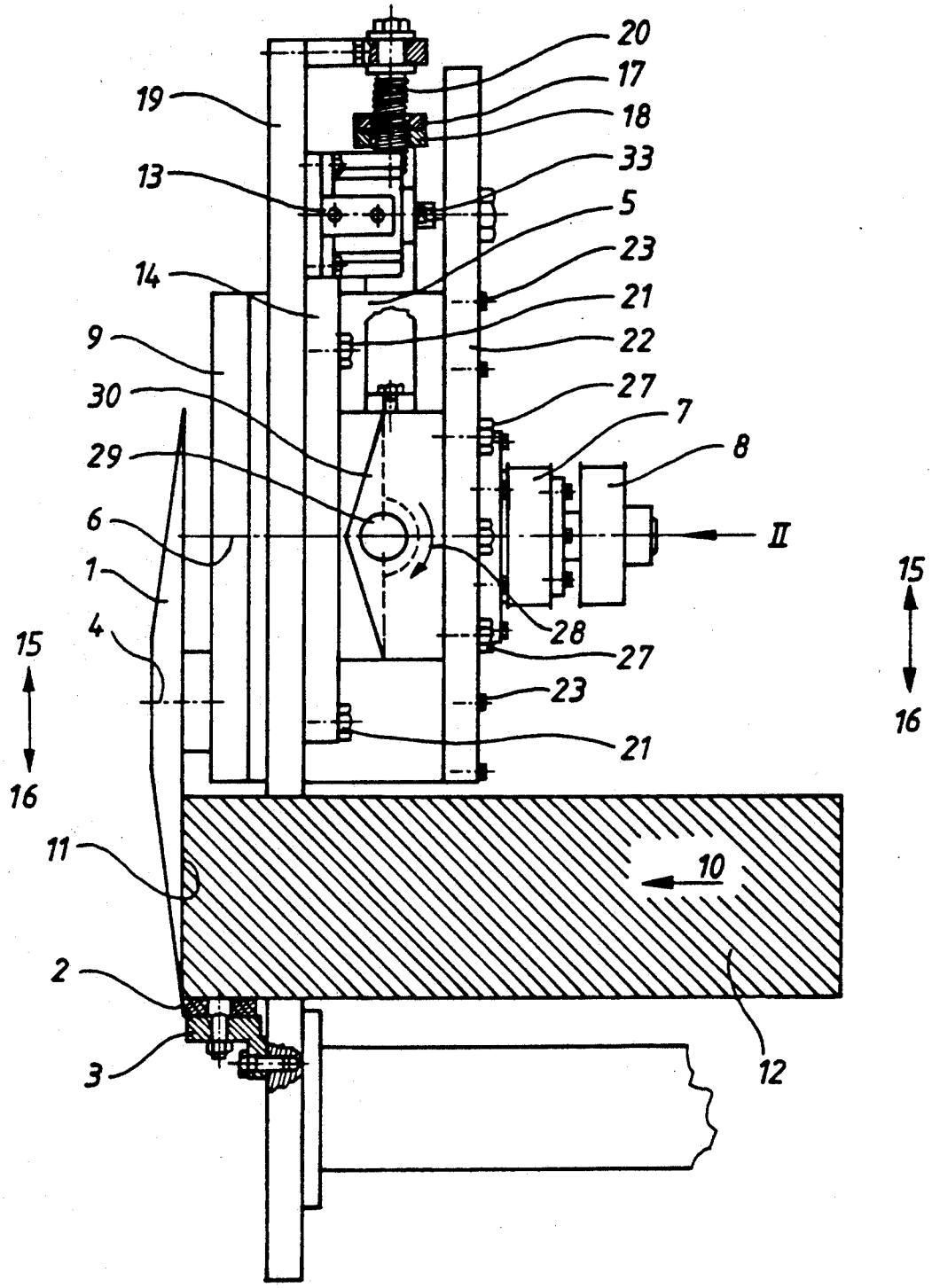
FIG. 1 shows a lateral view of the cutting device in accordance with the invention.

The circular knife 1 is driven in a cutting shaft 4 in a gear housing 5. It is driven by a belt pulley 7 over which runs a drive belt not shown here. As known, the gear housing 5 further features a belt pulley 8 which drives an eccentric disk 9 which rotates around the eccentric axis 6 in the gear housing 5. The circular knife 1 is rotatably mounted on the eccentric disk or support member 9.

As a result of the offset between the cutting shaft or axis 4 and the eccentric axis 6, the circular knife 1 carries out an orbital or planetary motion in a cutting plane 11 as the disk 9 rotates. A stationary counterknife 2 is attached to stationary support plate 19 via an angle member 3, and the counterknife has a cutting edge lying in the cutting plane 11. The circular knife will therefore move up and down in an orbital manner in the cutting plane 11 relative to the counterknife as the disk 9 rotates.

The product to be cut 12 is placed onto a product feed unit or feed device not shown here and is moved up intermittently in the direction 10 against the circular knife 1 whereby a cutting plane 11 is formed. In addition to the intermittent drive, the product 12 can also be moved continuously against the circular knife 1 in the direction of the cutting plane 11.

When the feed is out of operation, the cut product 12 may curve undesirably in the cutting plane 11, thus causing the circular knife 1 to cut undesirable shavings from the curving cutting plane 11.

In order to avoid this formation of shavings, the invention features an adjusting mechanism which can be integrated into the height adjustment in accordance with the invention. The adjusting mechanism brings the circular knife 1 out of contact with the cutting plane 11 through lateral displacement. Two different solutions are proposed to move the circular knife 1 from the cutting plane 11.

In a first variant for the lateral adjustment of the circular knife 1, the entire gear housing 5 pivots along the swivel axis 29 in the direction of the arrow 28 and in the opposite direction.

The swivel drive takes place in that the cylinder 13 is arranged on a part 14 of the cutting device and features a piston rod 33 which engages the swiveling part of the gear housing 5. This swiveling part is designed as a plate 22 connected to the gear housing 5 with screws.

The part 14 features a kind of hinge part 30 across from which are the pivoting surfaces of the gear housing 5.

In the second variant the circular knife 1 is moved by a rectilinear section from the cutting plane 11 in the direction of the arrow 10 in order to be able to carry out the adjustment procedures described below and in order to avoid the formation of shavings when shut off.

Both variants for the prevention of shavings can be integrated in the invention in which the circular knife 1 can be moved along the arrows 15, 16 as described below.

In a first variant, the one part of a spindle 20 whose head is held at the base plate 19 rests against a stationary base plate 19 in order to allow the entire gear housing 5 to move in the directions of arrow 15, 16. The threaded part passes through a spindle nut 17 secured to a bracket 18.

The bracket 18 is connected to the height-adjustable part of the gear housing with corresponding screws.

The gear housing 5 consists of the movable plate 22 connected to the part 14 with screws 23 via the hinge 30. Screws 21 hold and lock the movable part 14 on the base plate 19. The plate 22 is directly secured to the part 14 with screws if no stationary hinge 30 is attached with its stationary part to part 14 and with its pivoting part to plate 22. In this case, the plate 22 becomes completely superfluous whereby the drive is arranged in the part 14.

For better understanding, a portion of the plate 22 is broken away in FIG. 2 in order to show the parts below of the displacement. Also, the hinge 30 is not shown in FIG. 2 for a better overview.

In accordance with the first variant for height adjustment the plate 22 features a slotted hole 31 through which a key can be passed through in order to reach the setscrews 21 below. These setscrews 21 in turn pass through slotted holes 32 whereby each slotted hole 32 is arranged within reach of the movable and lockable part 14. When loosening the respective setscrews 21 the clamping between the part 14 and the base plate 19 is lifted; when activating the spindle 20, the bracket 18 is moved so that the circular knife 1 is moved in relation to the stationary counterknife 2 in the directions of arrow 15, 16 parallel to the cutting plane 11 of the product.

Figure 2:
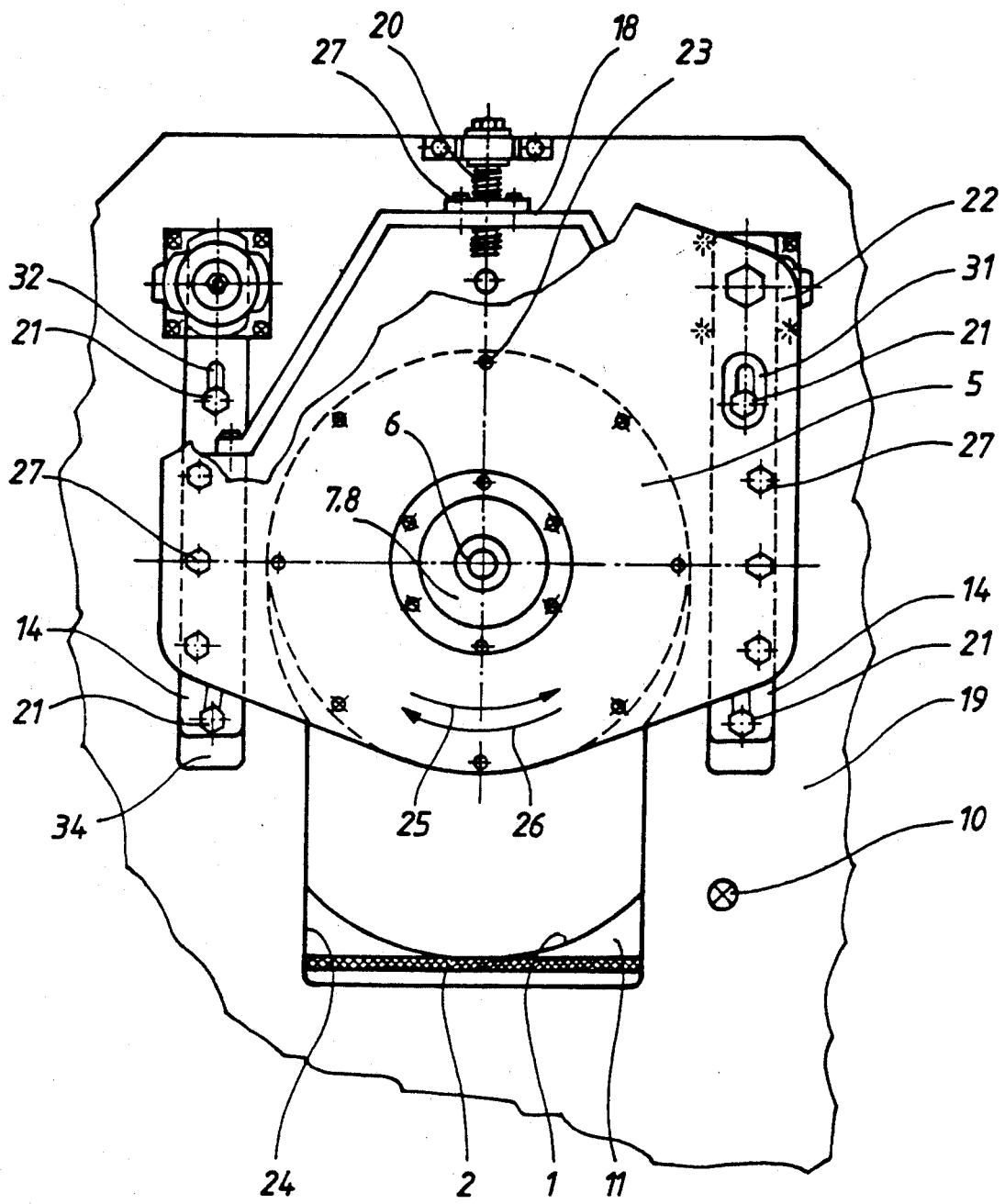
FIG. 2 shows the cutting device in accordance with FIG. 1 in a view in the direction of arrow II in FIG. 1.

As shown in FIG. 2, two parts 14 arranged parallel to one another engage longitudinal grooves 34. The longitudinal grooves 34 are embedded in the stationary base plate 19. Both parts 14 which are moved along the longitudinal grooves 34 and can be locked with the screws 21 are connected with one another through the bracket 18. When activating the spindle 20 whose spindle axis crosses the eccentric axis 6 in the symmetric set-up shown and is perpendicular to the counterknife 2, the circular knife attached to the plate 22 is moved up and down because the parts 14 are connected to the plate 22.

In order to achieve a tilted position of the circular knife 1, in particular for adjustment purposes, there are screws 27 which pass through the plate 22. The plate 22 is connected for example with the movable part 14 on the base plate 19 via the hinge 30. In accordance with FIG. 2, the screws 27 directly engage the movable part 14 and not the hinge 30. Pressure springs are arranged for example around the screws 27 between the part 14 and the plate 22 so that the eccentric axis 6 can be turned depending upon screw depth. If there is a hinge 30 instead of the pressure springs (not shown), the one hinge part is connected to the movable and lockable part 14. In this manner, the circular knife 1 can be moved and at the same time be turned along the axis 29 by changing the screw-in length of the screws 27.

FIG. 2 shows two screw series which are arranged symmetrically to the axis of the spindle 20. In each row, one screw lies across one screw of the other row on a given axis. This given axis crosses the eccentric axis 6. For both of the juxtaposed center screws from each screw row, the given axis in the variant shown in FIG. 2 coincides with the axis 29.

FIG. 2 also shows that the product 12 is moved down through an opening 24 of the cutting device in the drawing plane in the direction of arrow 10.

The circular knife 1 rotates in the direction of arrow 25 while the eccentric disk 9 rotates in the direction of arrow 26.

In FIG. 2 the upper adjustment position of the circular knife 1 is shown at the counterknife 2. In order to achieve a greater cutting width with reduced cutting height, the gear housing 5 is moved down in the direction of arrow 16 whereby the contact of the circular knife 1 with the counterknife 2 takes place over a larger surface area because the circular knife 1 is also moved down in the direction of arrow 16. However, there must always be contact with the counterknife 2 because otherwise the product 12 would not separate.

As shown in FIG. 2 by the directions of arrow 25, 26, the eccentric disk 9 runs in the direction 26 and therefore opposite to the direction of rotation 25 of the circular knife 1.

We claim:

1. A cutting device for cutting food products, in particular sausage, ham, bacon, meat, cheese and such, comprising:

a base plate;

a cutting head mounted on the base plate;

the cutting head comprising a drive unit, a first support member rotatably mounted on the drive unit for rotation about an eccentric axis, a circular knife rotatably mounted on the support member at a location offset from said eccentric axis for rotation in a cutting plane about an axis of rotation parallel to said eccentric axis, and drive means for rotating said support arm and circular knife;

a stationary counterknife for supporting a food product, the counterknife having a cutting edge arranged in the cutting plane;

a product feed unit for feeding the food product to the cutting plane; and moving means for moving the circular knife in a direction perpendicular to the counterknife and along the cutting plane to adjust the height of the circular knife relative to the stationary counterknife.

The moving means comprising an adjustment part carrying the drive unit, support member and circular knife, and an adjustment mechanism for adjustably mounting the adjustment part on the base plate to adjust the height of the adjustment part relative to the counterknife, the adjustment mechanism comprising a bracket engaging the adjustment part and a spindle adjustably connecting the bracket tot he stationary base plate, the spindle having a spindle axis which crosses the eccentric axis of the circular knife.

2. The cutting device as claimed in claim 1, including an adjustment device for tilting the circular knife relative to the cutting plane, and locking means for locking the circular knife in a selected tilted position.

3. The cutting device as claimed in claim 2, wherein the adjustment device includes at least two screws arranged on opposite sides of said eccentric axis.

4. The cutting device as claimed in claim 3, wherein the adjustment device includes two rows of screws, one row of screws being arranged on one side of said eccentric axis and the other row of screws being arranged on the opposite side of said eccentric axis, the screws having axes extending parallel to the eccentric axis, and each screw in one row being aligned with an opposing screw in the other row, two of the opposing screws lying on an axis which extends transversely across the eccentric axis.

5. The cutting device as claimed in claim 1, including hinge means for pivotally mounting the circular knife relative to the base plate, the hinge means having a swivel axis parallel to the cutting plane and comprising means for pivoting the circular knife into orientations tilted relative to the cutting plane.

6. The cutting device as claimed in claim 5, wherein the hinge means comprises a hinge plate hinged to said adjustment part, the support member being rotatably mounted on said hinge plate.

7. The cutting device as claimed in claim 6, including a swivel drive unit for pivoting the circular knife, the swivel drive unit comprising a cylinder and a piston rod extending out of the cylinder for movement between an extended position and a retracted position, the cylinder being secured to the adjustment part and the piston being secured to the hinge plate.

8. The cutting device as claimed in claim 1, wherein the base plate has a pair of longitudinal grooves and the adjustment part comprises a pair of parallel braces which are slidably mounted in the respective grooves.

9. The cutting device as claimed in claim 8, wherein the axes of the longitudinal grooves are perpendicular to the counterknife.

10. A cutting device for cutting food products into slices, comprising:

a base plate;

a cutting head mounted on the base plate;

the cutting head comprising a drive unit, a support member rotatably mounted for rotation about a first, eccentric axis, a circular knife rotatably mounted on the support member for rotation in a cutting plane about a knife axis parallel to and offset from said eccentric axis, said drive unit including drive means for rotating said support member and circular knife;

a stationary counterknife for supporting a food product, the counterknife having a cutting edge arranged in the cutting plane;

a product feed unit for feeding the food product to the cutting plane;

adjustment means for moving the circular knife in a direction perpendicular to the counterknife for adjusting the height of the circular knife relative to the stationary counterknife; and hinge means for pivotally mounting the circular knife relative to the support plate for tilting the circular knife relative to the cutting plane, the hinge means having a swivel axis extending parallel to the cutting plane.

* * * * *